US005256525A

United States Patent [19]

Southby et al.

[11] Patent Number: 5,256,525

[45] Date of Patent: Oct. 26, 1993

[54] BLOCKED INCORPORATED DEVELOPERS IN A PHOTOGRAPHIC ELEMENT

[75] Inventors: David T. Southby; Jared B. Mooberry; John Texter; John L. Pawlak, all of Rochester, N.Y.

[73] Assignee: Eastman Kodak Company

[21] Appl. No.: 810,944

[22] Filed: Dec. 19, 1991

[51] Int. Cl.[5] ..... G03C 5/30; G03C 7/305; G03C 7/388

[52] U.S. Cl. ..... 430/380; 430/405; 430/566; 430/443; 430/959; 430/943

[58] Field of Search ..... 430/405, 959, 566, 443, 430/943, 373, 461, 380

[56] References Cited

U.S. PATENT DOCUMENTS

| | | | |
|---|---|---|---|
| 4,474,872 | 10/1984 | Onishi et al. | 430/566 |
| 4,948,718 | 8/1990 | Factor et al. | 430/522 |
| 5,019,492 | 5/1991 | Buchanan et al. | 430/543 |
| 5,043,254 | 8/1991 | Nakagawa et al. | 430/405 |

*Primary Examiner*—Charles L. Bowers, Jr.
*Assistant Examiner*—Mark F. Huff
*Attorney, Agent, or Firm*—Foley & Lardner

[57] ABSTRACT

A photographic element is disclosed including a support bearing at least one photographic silver halide emulsion layer and at least one non-photosensitive layer between the emulsion layer and the support, wherein the non-photosensitive layer comprises at least one blocked developing agent.

25 Claims, No Drawings

BLOCKED INCORPORATED DEVELOPERS IN A PHOTOGRAPHIC ELEMENT

BACKGROUND OF THE INVENTION

This invention pertains to photographic elements, and in particular to photographic elements incorporating blocked photographic developers in a novel arrangement of layers.

It is well known in the art that the introduction of conventional color developers, such as p-aminophenols, into sensitized photographic elements containing silver halide salts, leads to desensitization of the silver halide emulsion and unsuitable fog in such layers. Much effort has therefore been directed at trying to produce effective blocked developers, which can be introduced in silver halide emulsion elements without deleterious desensitization or fog effects and which unblock chemically under conditions of development so that developer is free to participate in color forming (dye forming) reactions.

U.S. Pat. No. 3,342,599, to Reeves, discloses the use of Schiff base developer precursors. Schleigh and Faul, in a Research Disclosure (129 (1975) pp. 27–30), described the quaternary blocking of color developer and the acetamido blocking of p-phenylenediamines. Subsequently, U.S. Pat. No. 4,157,915, to Hamaoka et al., and U.S. Pat. No. 4,060,418, to Waxman and Mourning, describe the preparation and use of carbamate blocked p-phenylenediamines.

All of these approaches and inventions have failed in practical product applications because of one or more of the following problems: desensitization of sensitized silver halide; unacceptably slow unblocking kinetics; instability of blocked developer yielding increased fog and/or decreased Dmax after storage.

Recent developments in blocking and switching chemistry have led to blocked p-phenylenediamines that perform well. In particular, compounds having "β-ketoester" type blocking groups (strictly, β-ketoacyl blocking groups) are described in U.S. Pat. No. 5,019,492. With the advent of the β-ketoester blocking chemistry, it has become possible to incorporate p-phenylenediamine developers in film systems in a form from which they only become active when required for development.

The incorporation of these blocked developers in photographic elements is carried out using colloidal gelatin dispersions of the blocked developers. These dispersions are prepared using means well known in the art, wherein the developer precursor is dissolved in a high vapor pressure organic solvent (for example, ethyl acetate), along with, in some cases, a low vapor pressure organic solvent (such as dibutylphthalate), and then emulsified with an aqueous surfactant and gelatin solution. After emulsification, usually done with a colloid mill, the high vapor pressure organic solvent is removed by evaporation or by washing, as is well known in the art.

The β-ketoacyl blocked developers are released from the film layers in which they are incorporated by an alkaline developing solution containing a dinucleophile, for example hydroxylamine.

There has been a need for a photographic element incorporating a blocked developer which is stable until development. Then the element can be developed rapidly and easily. There has also been a need for a process for developing an image in a photographic element which employs a developing solution having a simplified composition.

SUMMARY OF THE INVENTION

This and other needs have been satisfied by providing a photographic element comprising a support bearing at least one photographic silver halide emulsion layer and at least one non-photosensitive layer between the emulsion layer and the support, wherein the non-photosensitive layer comprises at least one blocked developing agent.

In a preferred embodiment, the blocked developing agent has a structure according to the formula (I):

$$D—(T)_m—S \qquad (I)$$

in which

D is a silver halide developer,

T is a timing group, m is an integer from 0 to 6 and denotes the number of timing groups connected in series, and S is a blocking group.

In preferred embodiments, the blocking group is an acyl group, particularly preferably a β-ketoacyl group.

Additionally, there is provided a process for developing an image in a photographic element comprising a support, a photographic silver halide emulsion layer containing an imagewise distribution of developable silver halide grains, and a non-photosensitive layer between the emulsion layer and the support containing at least one blocked developing agent, comprising the step of contacting the element with a processing solution comprising a nucleophile. Preferably, the developing agent is blocked with an acyl group. Particularly preferably, the developing agent is blocked with a β-ketoacyl group and the nucleophile is a dinucleophile. Also preferably, the blocking group is a simple acyl group, and the nucleophile is a peroxide, particularly hydrogen peroxide.

Furthermore, there is provided a process for producing the foregoing photographic element which comprises the steps of providing a support, applying to the support a non-photosensitive layer comprising at least one blocked developing agent, and subsequently applying to the non-photosensitive layer a photographic silver halide emulsion layer.

DETAILED DESCRIPTION OF THE INVENTION

It has now been discovered that a photographic element having a blocked developing agent in a non-photosensitive layer disposed between the element support and the photosensitive layer or layers, can be developed more efficiently upon processing. It has further been discovered that the use of β-ketoacyl blocked developing agents in the non-photosensitive layer is particularly advantageous. Use of simple acyl blocked developing agents is also advantageous.

Related inventions and embodiments are described in U.S. patent application Ser. No. 07/810,241 (use of blocked photographically useful groups with peroxide-containing processes), U.S. patent application Ser. No. 810,322 (use of β-ketoacyl type blocked developers in image intensification chemistry systems) and U.S. patent application Ser. No. 810,232 (use of solid particle dispersions of β-ketoacyl blocked developers), filed simultaneously herewith and incorporated in their entireties by reference.

The invention achieves simplification of the composition of the developing solution, in that incorporation of a developing agent into the photographic element leads to a reduction in the concentration of developing agent in the processing solution required to obtain a high quality dye image. The developer solution is also utilized more efficiently.

Incorporation of blocked compounds in sensitized layers can lead to small but unwanted desensitization of the silver halide emulsion. Thus, separation of the emulsions and blocked developers by coating the latter in a non-sensitized layer of the photographic element overcomes this problem.

Incorporation of the blocked developer in a layer beneath an imaging layer in the photographic elements according to the invention also enables more efficient development of the element. This is because the release of developers from the blocked forms involves a series of chemical reactions during which intermediates having high mobility under development conditions are generated. These intermediates may diffuse from the photographic element into the bulk of the processing solution, which can result in an inefficiency in development. By coating the blocked developer beneath an imaging layer, the diffusion distance of the released intermediates to the developer solution is increased, and moreover, the compounds diffuse through the imaging layer before reaching the processing solution.

In formula I, the timing group(s), T, can contain one or more substituents to control the aqueous solubility of the precursor compound. Exemplary timing groups are disclosed in U.S. Pat. Nos. 4,248,962; 4,741,994; 4,772,537; 4,985,336; and 5,019,492, the disclosures of which are incorporated by reference. Up to six timing groups can be joined sequentially according to the invention (that is, m=0 to 6). Preferably, m=0, 1 or 2.

The blocking group S must have appropriate hydrolysis kinetics, that is, it must be a group that completely unblocks in the course of the development process. The blocking group S preferably is an acyl group, particularly a β-ketoacyl group as described in U.S. Pat. No. 5,019,492, or a simple acyl ester as described in Ser. No. 07/810,241. Exemplary preferred blocking groups include:

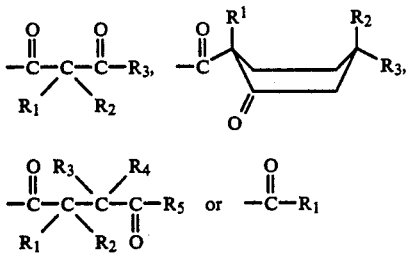

in which $R_1$, $R_2$, $R_3$, $R_4$ and $R_5$ individually are H or an unsubstituted or substituted alkyl group having 1 to 20 carbon atoms, and preferably are H or methyl. In the simple acyl blocking group, $R_1$ can be an unsubstituted or substituted alkyl, alkoxy, aryl or aryloxy group, as described in U.S. patent application Ser. No. 07/810,241.

The group S can also contain one or more substituents to control the aqueous solubility of the developer precursor. Exemplary substituents can include halogen, alkyl, aryl, heterocyclic, cyano, alkoxy, aryloxy, acyl, acylamino, anilino, ureido, alkylthio, arylthio, alkoxycarbonylamino, sulfonamido, unsubstituted or substituted carbamoyl, sulfamoyl, sulfonyl, alkyoxycarbonyl, heterocyclic oxy, acyloxy, carbamoyloxy, aryloxycarbonylamino, imido, heterocyclic thio, sulfinyl, phosphonyl, aryloxycarbonyl, alkylsulfonyl, arylsulfonyl, hydroxy, carboxy, and sulfo groups, as well as others known to those skilled in the art. The timing group T can likewise be substituted.

Both the timing and blocking groups can be unballasted or ballasted. In other words, at least one of T and S can include a group of such molecular size and configuration as to render the present compound nondiffusible as described, for example, in U.S. Pat. Nos. 4,420,556 and 4,923,789. Advantageous ballast groups include alkyl and aryl groups having from about 8 to 32 carbon atoms.

In formula I, the silver halide developer D can preferably be a color developer. The silver halide color developer D preferably is of the p-phenylenediamine or p-aminophenol type. Preferred developers according to the invention are given below in Table I. These developers according to the invention are prepared by well-known techniques, such as those described in U.S. Pat. No. 5,019,492, and also those described in U.S. patent application Ser. No. 07/700,006, U.S. patent application Ser. Nos. 07/810,241 and 07/810,322, as well as in U.S. Pat. No. 3,342,599, U.S. Pat. No. 4,060,418, and U.S. Pat. No. 4,157,915, the disclosures of each of which are incorporated in their entireties by reference.

The color developer, D, like the timing and blocking groups, may contain one or more substituents to control the aqueous and/or oil solubility of the developer precursor. Typical substituents include alkyl, hydroxyalkyl, sulfonamidoalkyl, sulfoalkyl, sulfo and carboxyalkyl, as well as others previously listed and known to those skilled in the art.

The preferred color developer compounds include those of the p-phenylenediamine type described in Table I, and in addition include analogous aminophenol compounds. The aminophenol compounds have structures according to the following formulas:

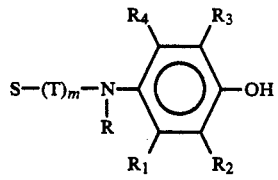

and

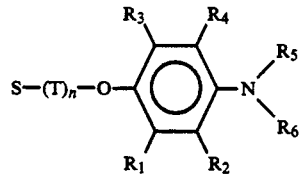

where S, T and m are as defined above. Here, R, $R_1$, $R_2$, $R_3$, $R_4$, $R_5$ and $R_6$ are independently H, halogen, alkyl, alkoxy, alkylsulfonamido, acylamido or aryl. Specific examples of such blocked aminophenols are listed in Table II.

Other blocked p-phenylenediamines of this invention include carbamate, oxamide, urea, thiourea, trihaloacetamido, perfluoroacyl, hydroxamic acid, and Schiff base derivatives. Examples of such blocked p-phenylenediamines are listed in Table III.

TABLE I

| V | Z | Y | X |
|---|---|---|---|
| | 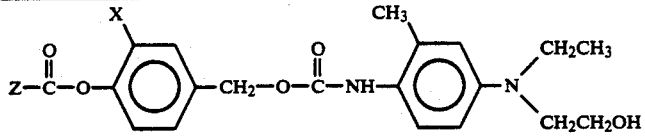 | | |
| 1 | $-C(CH_3)_2-CO-CH_3$ | | $-NHSO_2CH_3$ |
| 2 | $-C(CH_3)_2-CO-CH_3$ | | $-NHSO_2CH_2(CH_2)_{14}CH_3$ |
| 3 | $-C(CH_3)_2-CO-CH_3$ | | $-H$ |
| 4 | $-C(CH_3)_2-CO-CH_3$ | | $-NHCO(CH_2)_3CO_2C(CH_3)_3$ |
| 5 | $-C(CH_3)_2-CO-CH_3$ | | $-NHCO(CH_2)_3CO_2H$ |
| 6 | 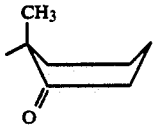 | | $-NHSO_2CH_3$ |
| 7 | $-CH(CH_3)_2$ | | $-H$ |
| | 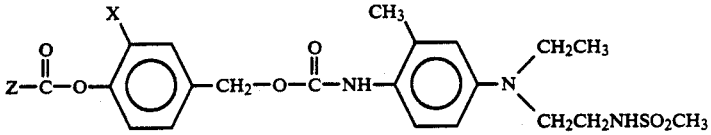 | | |
| 8 | $-C(CH_3)_2-CO-CH_3$ | | $-NHSO_2CH_3$ |
| 9 | $-C(CH_3)_3$ | | $-NHSO_2CH_3$ |
| 10 | 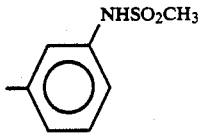 | | $-H$ |
| 11 | $-CH(CH_3)_2$ | | $-NHCO(CH_2)_3CO_2H$ |
| 12 | $-CH(CH_3)_2$ | | $-NHSO_2CH_3$ |
| 13 | $-CH_2CH_3$ | | $-NHCO(CH_2)_3CO_2H$ |
| 14 | 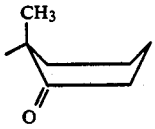 | | $-NHCO(CH_2)_3CO_2H$ |
| 15 | $-CH_2CH_3$ | | 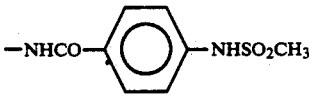 |
| 16 | 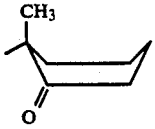 | | 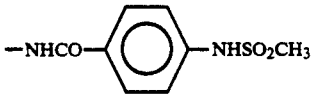 |
| 17 | 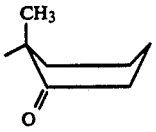 | | $-NHSO_2CH_3$ |
| | 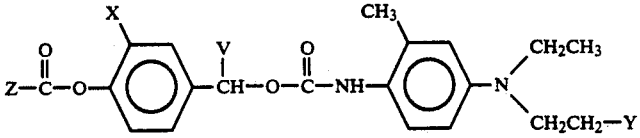 | | |

TABLE I-continued
| | V | Z | Y | X |
|---|---|---|---|---|
| 18 | —H | —$CH_2CH_3$ | —$NHSO_2CH_3$ | 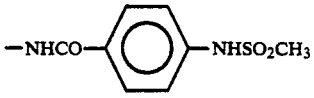 |
| 19 | —H | —$CH_2CH_3$ | —OH | 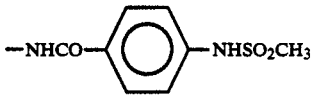 |
| 20 | —H | —$CH_2CH_3$ | —H | 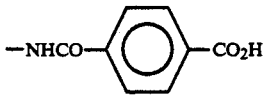 |
| 21 | —H | —$CH_3$ | —$NHSO_2CH_3$ | 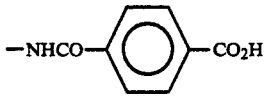 |
| 22 | —H | —$CH_2CH_2CH_3$ | —$NHSO_2CH_3$ | 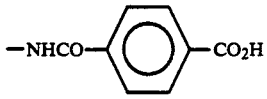 |
| 23 | —H | —$CH(CH_3)_2$ | —$NHSO_2CH_3$ | 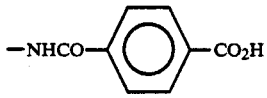 |
| 24 | —H | —$CH_2CH_3$ | —$NHSO_2CH_3$ | 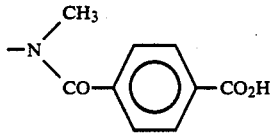 |
| 25 | —H | —$CH_2CH_3$ | —$NHSO_2CH_3$ | 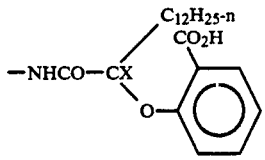 |
| 26 | —$CH_3$ | —$CH_2CH_3$ | —$NHSO_2CH_3$ | 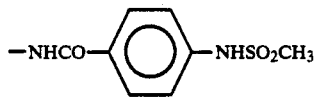 |
| 27 | —H | 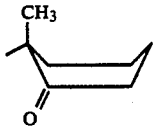 | —$NHSO_2CH_3$ | 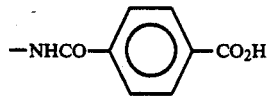 |
TABLE II
| Z | X | R | $R_1$ | $R_2$ |
|---|---|---|---|---|
| 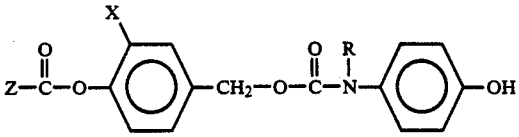 | | | | |
| 28 —$C(CH_3)_2$—CO—$CH_3$ | —$NHSO_2CH_3$ | —$CH_2CH_3$ | | |
| 29 —$C(CH_3)_2$—CO—$CH_3$ | —NH—CO—$(CH_2)_3CO_2H$ | —$CH_2CH_3$ | | |

TABLE II-continued
| | Z | X | R | $R_1$ | $R_2$ |
|---|---|---|---|---|---|
| 30 | $-C(CH_3)_2-CO-CH_3$ | 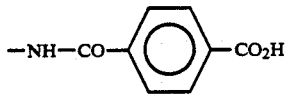 | $-CH_3$ | | |
| 31 | 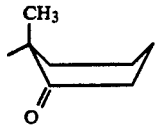 | 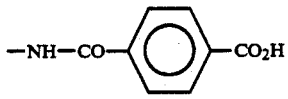 | $-CH_3$ | | |
| 32 | $-CH_2CH_3$ | 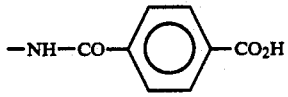 | $-CH_3$ | | |
| 33 | $-CH(CH_3)_2$ | $-NHSO_2CH_3$ | $-CH_2CH_3$ | | |
| 34 | $-CH(CH_3)_2$ | 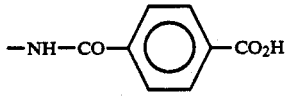 | $-CH_3$ | | |
| 35 | $-CH(CH_3)_2$ | 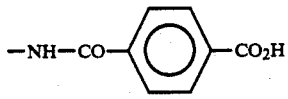 | $-H$ | | |
| | | 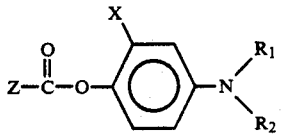 | | | |
| 36 | $-CH_3$ | $-OCH_3$ | | $-CH_2CH_3$ | $-CH_2CH_3$ |
| 37 | $-CH(CH_3)_2$ | $-H$ | | $-CH_2CH_2OH$ | $-CH_2CH_3$ |
| 38 | $-CH_2CH_3$ | $-NHSO_2CH_3$ | | $-CH_3$ | $-CH_3$ |
| 39 | $-CH_2CH_3$ | $-H$ | | $-CH_2CH_3$ | $-CH_2CH_3$ |
TABLE III
| | | | |
|---|---|---|---|
| 40 | 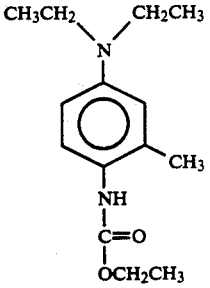 | 41 | 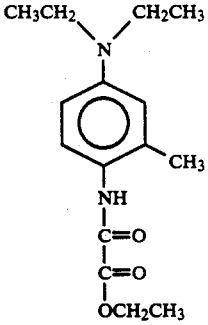 |
| 42 | 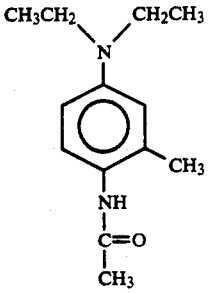 | 43 | 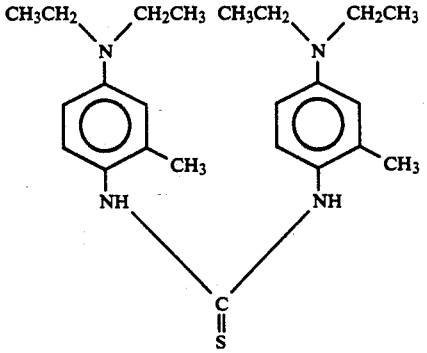 |

TABLE III-continued
44
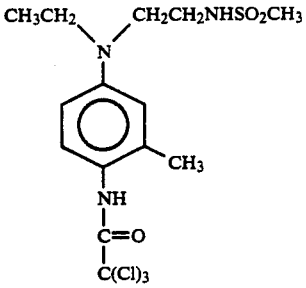
45
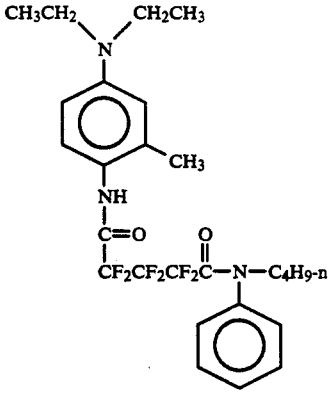
46
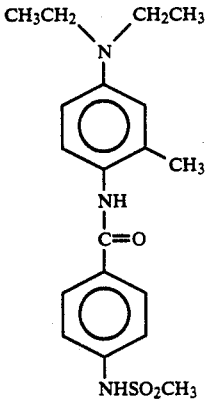
47
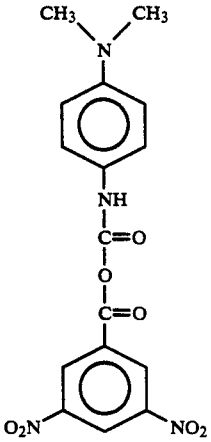
48
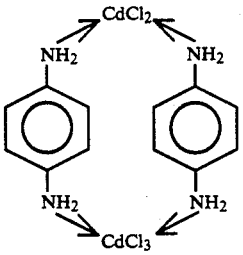
49
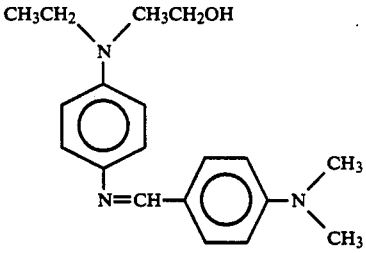
50
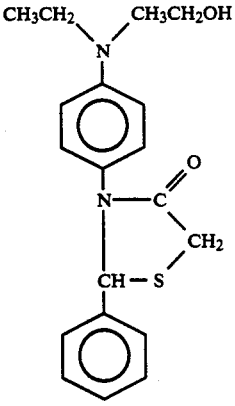
51
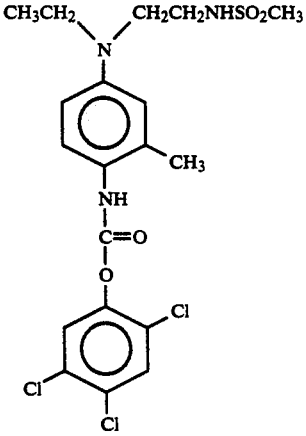

TABLE III-continued

52 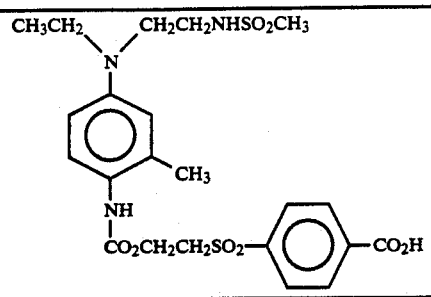

53 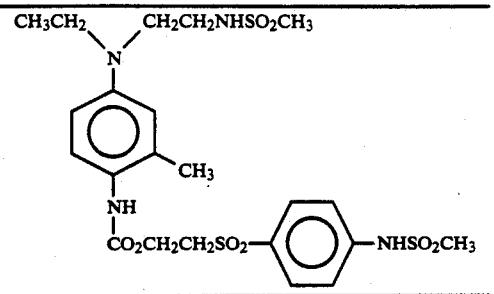

The blocked developing agents according to the invention can be incorporated in the non-photosensitive layer, for example, as a dispersion, including a dispersion of solid particles as described in U.S. patent application Ser. No. 07/810,232. Another method is to add the blocked developer to a melt as a solution in an organic, water-miscible solvent. Other incorporation methods will be readily apparent to those skilled in the art.

In the following discussion of suitable materials for use in the emulsions and elements according to the invention, reference will be made to *Research Disclosure,* December 1989, Item 308119, published by Kenneth Mason Publications Ltd., Emsworth, Hampshire PO10 7DQ, U.K., the disclosures of which are incorporated in their entireties herein by reference. This publication will be identified hereafter as "Research Disclosure".

The support of the element of the invention can be any of a number of well known supports for photographic elements. These include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

The photographic elements according to the invention can be coated on the selected supports as described in Research Disclosure Section XVII and the references cited therein.

The radiation-sensitive layer of a photographic element according to the invention can contain any of the known radiation-sensitive materials, such as silver halide, or other light sensitive silver salts. Silver halide is preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes.

The silver halide emulsions employed in the elements according to the invention can be either negative-working or positive-working. Suitable emulsions and their preparation are described in Research Disclosure Sections I and II and the publications cited therein.

Also useful are tabular grain silver halide emulsions. In general, tabular grain emulsions are those in which greater than 50 percent of the total grain projected area comprises tabular grain silver halide crystals having a grain diameter and thickness selected so that the diameter divided by the mathematical square of the thickness is greater than 25, wherein the diameter and thickness are both measured in microns. An example of tabular grain emulsions is described in U.S. Pat. No. 4,439,520. Suitable vehicles for the emulsion layers and other layers of elements according to the invention are described in Research Disclosure Section IX and the publications cited therein.

The radiation-sensitive materials described above can be sensitized to a particular wavelength range of radiation, such as the red, blue, or green portions of the visible spectrum, or to other wavelength ranges, such as ultraviolet, infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, or other known spectral sensitizers. Exemplary sensitizers are described in Research Disclosure Section IV and the publications cited therein.

Multicolor photographic elements according to the invention generally comprise a blue-sensitive silver halide layer having a yellow color-forming coupler associated therewith, a green-sensitive layer having a magenta color-forming coupler associated therewith, and a red-sensitive silver halide layer having a cyan color-forming coupler associated therewith. Color photographic elements and color-forming couplers are well-known in the art. The elements according to the invention can include couplers as described in Research Disclosure Section VII, paragraphs D, E, F and G and the publications cited therein. These couplers can be incorporated in the elements and emulsions as described in Research Disclosure Section VII, paragraph C and the publications cited therein.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. During processing, the developer precursor compound of formula I will generally be solubilized and undergo a sequence of reactions to release the color developer. Processing can be any type of known photographic processing, although it is preferably carried out at pH 9 to 14 and includes a nucleophile such as hydrogen peroxide, hydroxylamine, perborate, an alkyl peroxide, an aryl peroxide, or a compound releasing such nucleophiles.

In particular, when S is a β-ketoacyl group, the nucleophile is a dinucleophile, as discussed in U.S. Pat. No. 5,019,492. When S is a simple acyl group, the nucleophile preferably is a peroxide having the structure $$R_6—OOH$$

in which $R_6$ is H or an unsubstituted or substituted alkyl, aryl, alkaryl, aralkyl or acyl group. $R_6$ can also be a sulfonyl, oxycarbonyl or borate group, or any group in general which hydrolyzes readily in alkaline solution to yield hydrogen peroxide. Hydrogen peroxide is the particularly preferred reagent (hydrogen peroxide is present as a salt in alkaline solution, that is, in the form $H—O—OM^+$, which is the active species).

A negative image can be developed by color development using one or more of the aforementioned nucleophiles. A positive image can be developed by first developing with a nonchromogenic developer, then uniformly fogging the element, and then developing by a process employing one or more of the aforementioned nucleophiles. If the material does not contain a color-forming coupler compound, dye images can be produced by incorporating a coupler in the developer solutions.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The invention is further illustrated by the following examples, without being limited thereby.

EXAMPLE 1

Three β-ketoacyl blocked developers (nos. 6, 8 and 16) were dispersed in di-n-butylphthalate (DBP) such that the ratio developer:DBP:ethyl acetate was 1:1/2:1 1/2, and the dispersion was 3% developer and 4% gelatin. The dispersions were used unwashed.

The β-ketoacyl blocked developer dispersions incorporated in the non-photosensitive layer of the monochrome tri-layer test format shown in Table IV below. The emulsion-containing layer contained image coupler A and a green sensitized bromoiodide emulsion.

TABLE IV

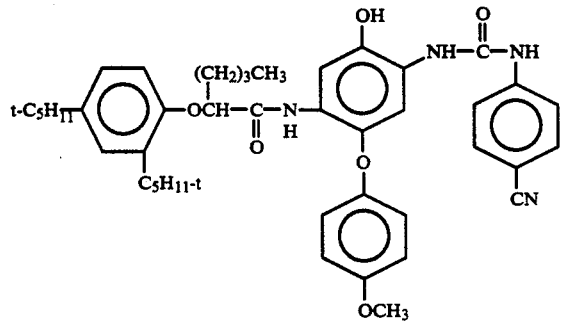

coupler A

| | |
|---|---|
| DOC | Gelatin (5375 mg/m²)<br>1,1'-(oxybis(methylenesulfonyl))bis-ethene hardener (2% of total gelatin)<br>saponin (1.5% melt volume) |
| EMULSION LAYER | Gelatin (2152 mg/m²)<br>Coupler A (806 mg/m²)<br>green sensitized AgBrI emulsion, 6.4 mol % iodide, with mean particle size 0.46 μm (1613 mg/m² as Ag)<br>saponin (1.5% melt volume) |
| UNDERLAYER | Gelatin (2688 mg/m²)<br>+/− β-ketoacyl blocked developer (1.12 or 2.24 mmol/m²)<br>saponin (1.5% melt volume) |
| | FILMBASE |

Coatings were exposed and processed at 100° F. using a development step of 4 mins. in pH10 potassium carbonate buffer with or without 2.41 g/L of hydroxylamine sulphate (HAS). The remainder of the process was according to a C41 protocol modified to include a stop bath.

Sensitometric results are shown in Table V below.

TABLE V

| BLOCKED DEVELOPER | LEVEL mmol/m² | Dmin | Dmax | Contrast[a] | Speed[b] | Dmax-no HAS |
|---|---|---|---|---|---|---|
| check | — | 0.04 | 0.05 | 0.02 | — | 0.04 |
| 6 | 1.12 | 0.09 | 0.50 | 0.29 | 165 | 0.04 |
| | 2.24 | 0.15 | 0.84 | 0.58 | 139 | 0.04 |
| 8 | 1.12 | 0.09 | 0.57 | 0.34 | 191 | 0.04 |
| | 2.24 | 0.15 | 0.93 | 0.57 | 181 | 0.09 |
| 16 | 1.12 | 0.12 | 0.76 | 0.46 | 200 | 0.04 |
| | 2.24 | 0.17 | 1.15 | 0.78 | 190 | 0.04 |
| check | — | 0.04 | 0.05 | 0.03 | — | 0.04 |

[a]Contrast is defined as the maximum slope between any two density points which are two steps apart.
[b]Speed is defined as the exposure at which the density above Dmin is 20% of the average gradient from that point to 0.6 log E greater exposure.

No coating processed using potassium carbonate solution alone gave a Dmax greater than 0.1. The absence of any substantial development of dye in the absence of HAS demonstrates the stability of the blocked developers.

COMPARATIVE EXAMPLE 1

Blocked developers 6 and 8 were dispersed in DBP as in Example 1. The blocked developer dispersions were then incorporated into the emulsion layer of a monochrome bi-layer test format similar to the upper two layers of the test format in Table IV. The bi-layer test format is shown in Table VI below.

TABLE VI

| | |
|---|---|
| DOC | Gelatin (5375 mg/m$^2$)<br>1,1'-(oxybis(methylenesulfonyl))bis-ethene hardener (2% of total gelatin)<br>saponin (1.5% melt volume) |
| EMULSION LAYER | Gelatin (3225 mg/m$^2$)<br>Coupler A (806 mg/m$^2$)<br>green sensitized AgBrI emulsion, 6.4 mol %, with mean particle size 0.46 μm (1613 mg/m$^2$ as Ag)<br>+/− β-ketoacyl blocked developer (1.12 or 2.24 mmol/m$^2$)<br>saponin (1.5% melt volume)<br>FILMBASE |

Coatings were exposed and processed as in Example 1. Sensitometric results are tabulated in Table VII below.

TABLE VII

| BLOCKED DEVELOPER | LEVEL mmol/m$^2$ | Dmin | Dmax | Contrast | Speed | Dmax-no HAS |
|---|---|---|---|---|---|---|
| check | — | 0.05 | 0.07 | 0.02 | — | 0.04 |
| 6 | 1.12 | 0.11 | 0.43 | 0.28 | 150 | 0.06 |
| | 2.24 | 0.17 | 0.70 | 0.44 | 148 | 0.09 |
| 8 | 1.12 | 0.09 | 0.44 | 0.29 | 155 | 0.08 |
| | 2.24 | 0.13 | 0.81 | 0.54 | 148 | 0.14 |
| check | — | 0.05 | 0.07 | 0.02 | — | 0.04 |

The differences in Dmax, contrast (DOG) and speed between the two coating formats are given in Table VIII, below. A positive value indicates that the response was greater when the blocked developer was incorporated in the non-photosensitive underlayer below the emulsion layer.

TABLE VIII

| BLOCKED DEVELOPER | LEVEL mmol/m$^2$ | Dmax | Contrast | Speed | Dmax-no HAS |
|---|---|---|---|---|---|
| check | — | −0.02 | — | — | 0.0 |
| 6 | 1.12 | 0.07 | 0.01 | 15 | −0.02 |
| | 2.24 | 0.14 | 0.14 | 3 | −0.05 |
| 8 | 1.12 | 0.13 | 0.05 | 36 | −0.04 |
| | 2.24 | 0.12 | 0.03 | 33 | −0.05 |
| check | — | −0.02 | 0.01 | — | — |

Incorporation of blocked developers in photographic elements according to the present invention enables dye formation with simple developing solutions, with the potential for an increased rate of development in lower layers due to generation of high local concentrations of color developer.

It is to be understood that the foregoing detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A photographic element comprising a support bearing at least one photographic silver halide emulsion layer and at least one non-photosensitive layer between said emulsion layer and said support, wherein said non-photosensitive layer comprises at least one blocked developing agent.

2. A photographic element as claimed in claim 1, wherein said blocked developing agent has a structure according to the formula (I):

$$D-(T)_m-S \qquad (I)$$

in which

D is a silver halide developer,

T is a timing group, m is an integer from 0 to 6 and denotes the number of timing groups connected in series, and S is a blocking group.

3. A photographic element as claimed in claim 2, wherein D is a color developer.

4. A photographic element as claimed in claim 3, wherein D is an unsubstituted or substituted p-phenylenediamine group or an unsubstituted or substituted p-aminophenol group.

5. A photographic element as claimed in claim 2, wherein S is an acyl group.

6. A photographic element as claimed in claim 5, wherein S is a β-ketoacyl group.

7. A photographic element as claimed in claim 6, wherein S is

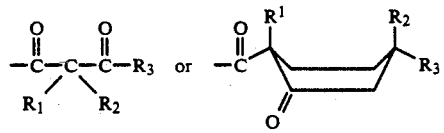

in which $R_1$, $R_2$ and $R_3$ are independently H or an alkyl group having 1 to 20 carbon atoms.

8. A photographic element as claimed in claim 6, wherein S is

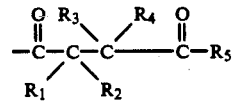

in which $R_1$, $R_2$, $R_3$, $R_4$ and $R_5$ are independently H or an alkyl group having 1 to 20 carbon atoms.

9. A photographic element as claimed in claim 2, wherein S is

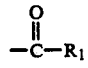

in which $R_1$ an unsubstituted or substituted alkyl, alkoxy, aryl or aryloxy group.

10. A photographic element as claimed in claim 2, wherein at least one of S and T is ballasted.

11. A photographic element as claimed in claim 2, wherein at least one of S, T and D has a substituent that increases the solubility of said blocked developing agent.

12. A photographic element as claimed in claim 1, further comprising a dye-forming coupler associated with said silver halide emulsion.

13. A multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, and a non-photosensitive layer disposed between said support and said blue-, green- and yellow-sensitive silver halide emulsion layers, wherein said non-photosensitive layer comprises at least one blocked developing agent.

14. A process for developing an image in a photographic element comprising a support, a photographic silver halide emulsion layer containing an imagewise distribution of developable silver halide grains, and a non-photosensitive layer between said emulsion layer and said support containing at least one blocked developing agent, said process comprising the step of contacting said element with a processing solution comprising a nucleophile.

15. A process as claimed in claim 14, wherein said blocked developing agent has the structure $$D-(T)_m-S$$

in which

D is a silver halide developer,

T is a timing group, m is an integer from 0 to 6, and

S is a blocking group.

16. A process as claimed in claim 15, wherein D is a color developing agent.

17. A process as claimed in claim 16, wherein D is an unsubstituted or substituted p-phenylenediamine group or an unsubstituted or substituted p-aminophenol group.

18. A process as claimed in claim 15, wherein S is an acyl group.

19. A process as claimed in claim 18, wherein S is a $\beta$-ketoacyl group and said nucleophile is a dinucleophile.

20. A process as claimed in claim 19, wherein S is

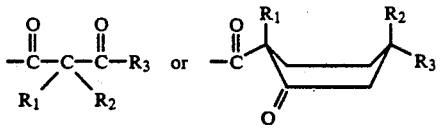

in which $R_1$, $R_2$ and $R_3$ are independently H or an alkyl group having 1 to 20 carbon atoms.

21. A process as claimed in claim 18, wherein S is

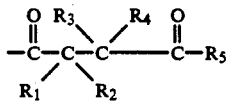

in which $R_1$, $R_2$, $R_3$, $R_4$ and $R_5$ are independently H or an alkyl group having 1 to 20 carbon atoms.

22. A process as claimed in claim 18, wherein S is

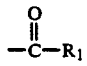

in which $R_1$ an unsubstituted or substituted alkyl, alkoxy, aryl or aryloxy group, and said nucleophile is a peroxide having the structure $$R_6-OOH$$

in which $R_6$ is H or an unsubstituted or substituted alkyl, aryl, alkaryl, aralkyl, acyl, sulfonyl, oxycarbonyl or borate group, or a salt thereof or a derivative thereof which is hydrolyzable to said peroxide in alkaline solution.

23. A process as claimed in claim 22, wherein $R_6$ in said peroxide is a group which is hydrolyzable in alkaline solution, whereby said peroxide forms hydrogen peroxide.

24. A process as claimed in claim 22, wherein said peroxide is hydrogen peroxide, a salt thereof or a derivative thereof which is hydrolyzable to hydrogen peroxide in alkaline solution.

25. A process for producing a photographic element which comprises the steps of providing a support, applying to said support a non-photosensitive layer comprising at least one blocked developing agent, and subsequently applying to said non-photosensitive layer a photographic silver halide emulsion layer.

* * * * *